US011005198B2

(12) United States Patent
Iwamoto

(10) Patent No.: US 11,005,198 B2
(45) Date of Patent: May 11, 2021

(54) CONNECTOR

(71) Applicant: HOSIDEN CORPORATION, Osaka (JP)

(72) Inventor: Yuta Iwamoto, Osaka (JP)

(73) Assignee: HOSIDEN CORPORATION, Osaka (JP)

( * ) Notice: Subject to any disclaimer, the term of this patent is extended or adjusted under 35 U.S.C. 154(b) by 69 days.

(21) Appl. No.: 16/674,319

(22) Filed: Nov. 5, 2019

(65) Prior Publication Data

US 2020/0161782 A1 May 21, 2020

(30) Foreign Application Priority Data

Nov. 16, 2018 (JP) ..... JP2018-215427

(51) Int. Cl.
*H01R 24/00* (2011.01)
*H01R 12/70* (2011.01)
(Continued)

(52) U.S. Cl.
CPC ..... *H01R 12/7064* (2013.01); *H01R 12/716* (2013.01); *H01R 13/42* (2013.01); *H01R 13/627* (2013.01); *H01R 24/50* (2013.01)

(58) Field of Classification Search
CPC .. H01R 12/7064; H01R 12/716; H01R 13/42; H01R 13/627; H01R 24/50;
(Continued)

(56) References Cited

U.S. PATENT DOCUMENTS 5,026,301 A * 6/1991 Balyasny ..... H01R 4/2404 29/866
5,577,937 A * 11/1996 Itoh ..... H01R 13/6625 439/620.22
(Continued)

FOREIGN PATENT DOCUMENTS

EP 3605740 2/2020
JP 2008-123997 5/2008
(Continued)

OTHER PUBLICATIONS

European Search Report, European Patent Office, Application No. 19209207.0, dated Mar. 27, 2020.

*Primary Examiner* — Abdullah A Riyami
*Assistant Examiner* — Nelson R. Burgos-Guntin
(74) *Attorney, Agent, or Firm* — Greenblum & Bernstein, P.L.C.

(57) ABSTRACT

A connector includes a body and a contact that is inserted into the body. The contact includes a protruding part that is protruded in a direction orthogonal to an insertion direction of the contact, a protrusion that is provided on an outer periphery of the contact, and an overhanging part that overhangs in the direction orthogonal to the insertion direction. The body includes, on an inner surface thereof, a guide groove that is fitted with the protruding part and is extended in the insertion direction, a housing part that has an internal dimension for press-fitting the contact, which includes the protrusion, thereto, and a press-fitting part that has an internal dimension for press-fitting the contact, which includes the overhanging part, thereto. An insertion distance A of the protruding part, an insertion distance B of the protrusion, and an insertion distance C of the overhanging part satisfy a relation A>B>C.

6 Claims, 7 Drawing Sheets

(51) Int. Cl.
*H01R 12/71* (2011.01)
*H01R 13/42* (2006.01)
*H01R 13/627* (2006.01)
*H01R 24/50* (2011.01)

(58) Field of Classification Search
CPC ..... H01R 13/111; H01R 2101/00; H01R 13/4223; H01R 13/41; H01R 24/38; H01R 13/629
See application file for complete search history.

(56) References Cited

U.S. PATENT DOCUMENTS 5,803,757 A * 9/1998 Wang ..... H01R 24/46 439/188
10,535,958 B2 * 1/2020 Kondo ..... H01R 13/508
2006/0040565 A1 * 2/2006 Chen ..... H01R 13/642 439/677
2006/0110982 A1 * 5/2006 Shinmyo ..... H01R 13/6592 439/607.51
2012/0149227 A1 * 6/2012 Yoshida ..... H01R 13/5202 439/277
2014/0038473 A1 * 2/2014 Kojima ..... H01R 13/18 439/851
2015/0318632 A1 * 11/2015 Matsumura ..... H01R 13/4223 439/752
2015/0349460 A1 * 12/2015 Fukaya ..... H01R 13/6272 439/345
2015/0380863 A1 * 12/2015 Uchida ..... H01R 13/5205 439/587
2016/0315427 A1 * 10/2016 Kawakami ..... H01R 13/6594
2016/0315428 A1 * 10/2016 Kawakami ..... H01R 24/50
2016/0344110 A1 * 11/2016 Sone ..... H01R 24/58
2017/0346201 A1 * 11/2017 Yoshida ..... G01N 27/409
2019/0006773 A1 * 1/2019 Hirakawa ..... H01R 4/48
2019/0027865 A1 * 1/2019 Sakaue ..... H01R 13/20
2020/0036140 A1 1/2020 Iwamoto et al.
2020/0153169 A1 * 5/2020 Yamaguchi ..... H01R 13/582
2020/0161782 A1 * 5/2020 Iwamoto ..... H01R 13/627
2020/0223321 A1 * 7/2020 Myer ..... B60L 53/16
2020/0274298 A1 * 8/2020 Hashimoto ..... H01R 24/50
2020/0335886 A1 * 10/2020 Glueck ..... H01R 13/111
2020/0358216 A1 * 11/2020 Hieber ..... H05K 3/303
2021/0005995 A1 * 1/2021 Mangstl ..... H01R 43/00

FOREIGN PATENT DOCUMENTS

JP 2012-138201 7/2012
JP 5757198 7/2015

* cited by examiner

CONNECTOR

TECHNICAL FIELD

The present invention relates to a connector.

BACKGROUND ART

Japanese Registered Patent No. 5757198 (hereinafter referred to as Patent Literature 1), for example, discloses a conventional connector. The connector of Patent Literature 1 is provided to suppress rotation of a terminal metal fitting in a connector housing, and includes: a connector housing that is made of resin and holds an external conductor terminal, which has a tubular connection part having a cylindrical shape, thereinside; a terminal housing part that is formed in an inside of the connector housing and to which the tubular connection part is inserted; a guide groove that is formed to be recessed in inner walls positioned on both sides in the left and right direction of the terminal housing part and extends in the front and back direction; and a housing press-fitting protrusion that is formed to be protruded from an outer surface of the tubular connection part toward the outside in a diameter direction in a tapered shape and is press-fitted to both-side inner walls, which position on both sides in the left and right direction of the guide groove, when being housed in the guide groove.

Concentricity of respective components is the important matter related to fit in a connector, but it has been sometimes difficult to appropriately control concentricity of respective components because of downsizing and structure complication of connectors. For example, position control is performed by a positioning piece and a positioning piece housing recession (slit) and positioning and holding are performed by the housing press-fitting protrusion (projection) in the connector of Patent Literature 1. However, concentricity is not taken into account and required concentricity might not be secured accordingly.

SUMMARY OF THE INVENTION

An object of the present invention is to provide a connector which is capable of appropriately controlling concentricity.

The present invention is a connector including a body and a contact that is inserted into the body. The contact includes a protruding part that is protruded in a direction orthogonal to an insertion direction of the contact, a protrusion that is provided on an outer periphery of the contact, and an overhanging part that overhangs in the direction orthogonal to the insertion direction. The body includes, on an inner surface thereof, a guide groove that is fitted with the protruding part and is extended in the insertion direction, a housing part that has an internal dimension for press-fitting the contact, which includes the protrusion, thereto, and a press-fitting part that has an internal dimension for press-fitting the contact, which includes the overhanging part, thereto. An insertion distance A of the protruding part from a position, on which the protruding part starts to fit in the guide groove, to a terminal position, an insertion distance B of the protrusion from a position, on which press-fit of the protrusion is started, to a terminal position, and an insertion distance C of the overhanging part from a position, on which press-fit of the overhanging part is started, to a terminal position satisfy a relation A>B>C.

Effects of the Invention

According to a connector of the present invention, concentricity can be appropriately controlled.

DETAILED DESCRIPTION

Figure 1:
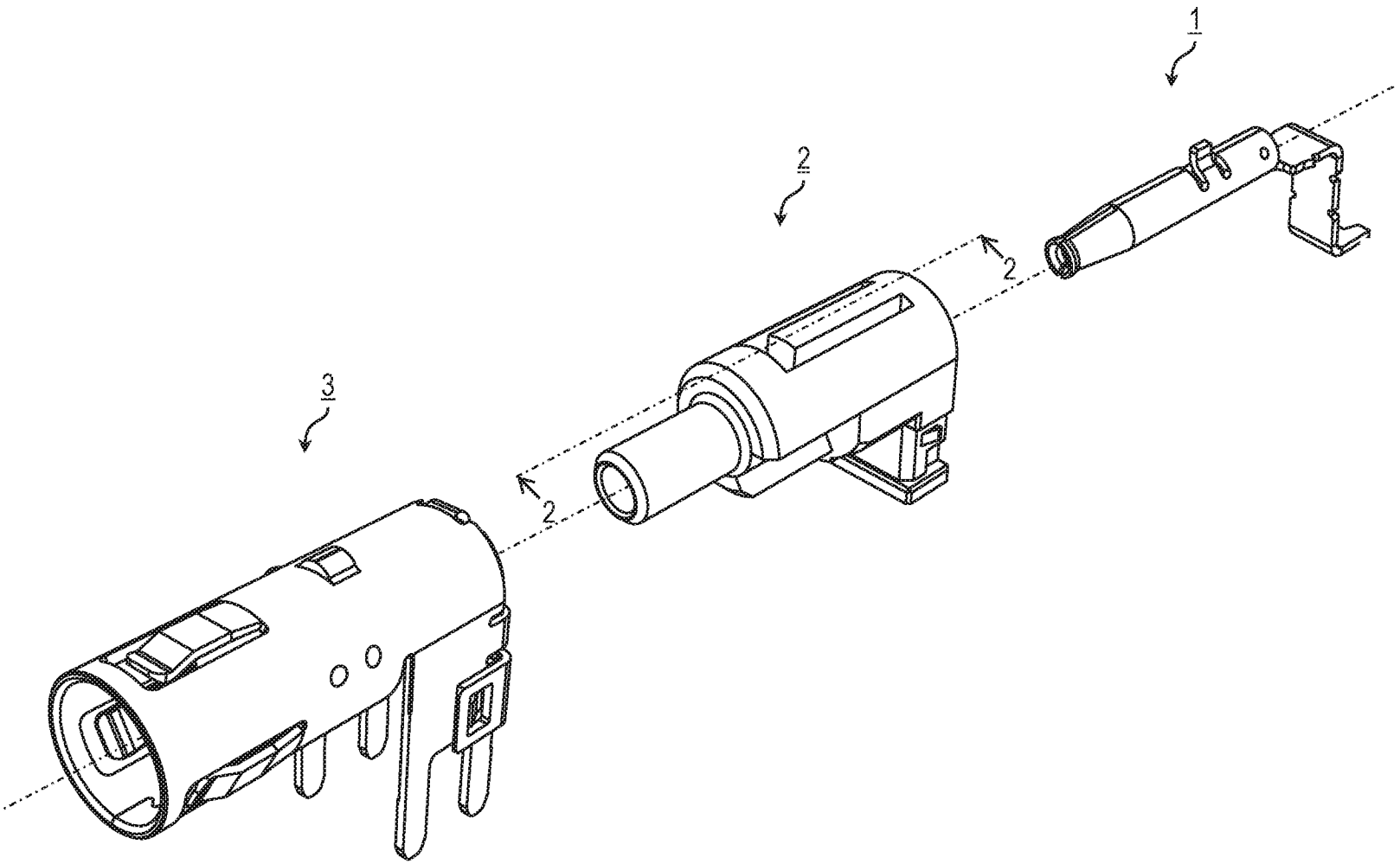
FIG. 1 is a perspective view of a contact, a body, and a shell of a connector according to a first embodiment.

An embodiment of the present invention is described in detail below. Here, elements having the same functions are given the same reference characters and duplicate description thereof is omitted.

First Embodiment

A connector according to the present embodiment is configured to include a contact 1, a body 2, and a shell 3 having a substantially cylindrical shape, as illustrated in FIG. 1. The contact 1 is inserted into the body 2. The body 2 is inserted into the shell 3. The body 2 is made of an insulator (resin, for example). The contact 1 and the shell 3 are made of metal.

<Front Edge Part 16, Main Body Part 17, and Terminal End Part 18>

Figure 2B:
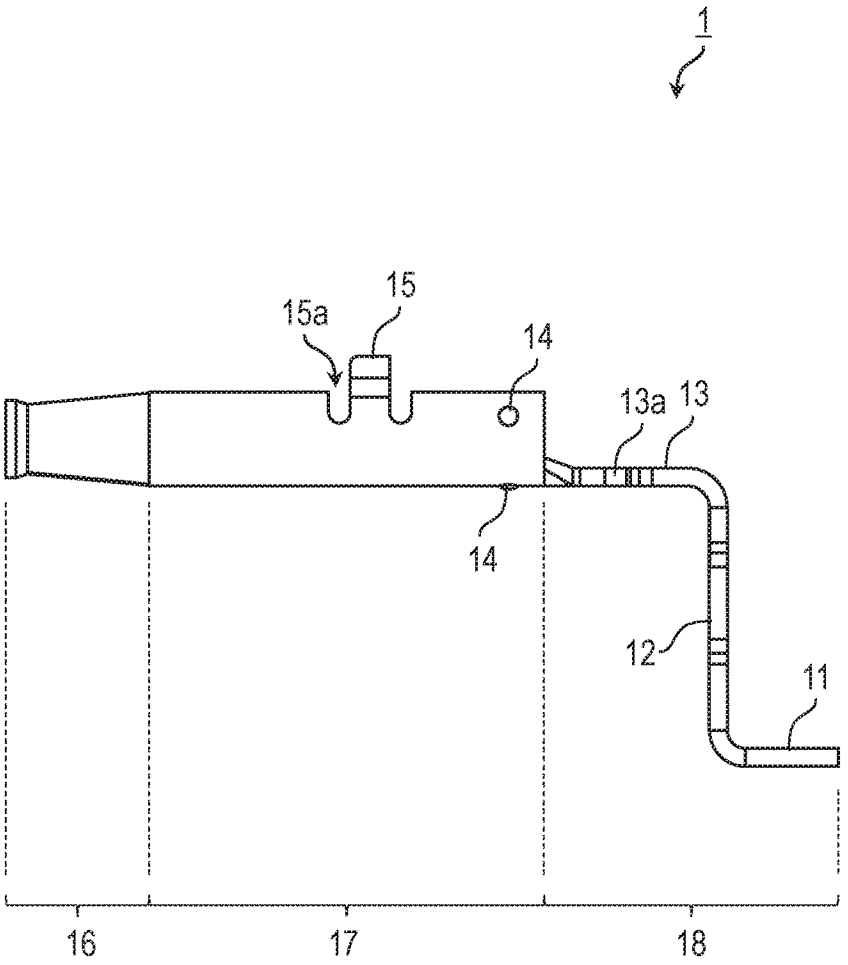
FIG. 2A is a sectional view on a 2-2 section of the body of the connector according to the first embodiment and FIG. 2B is a right side surface view of the contact.
Figure 3:
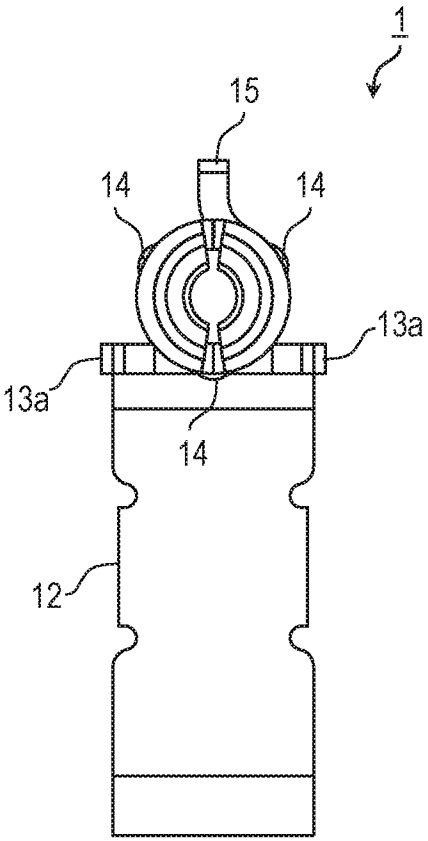
FIG. 3 is a front elevational view of the contact of the connector according to the first embodiment.

As illustrated in FIG. 2B and FIG. 3, the contact 1 includes a front edge part 16, a terminal end part 18, and a main body part 17. The front edge part 16 is positioned on a front edge in a contact insertion direction and is cylindrically formed to have a truncated cone shape. The terminal end part 18 is positioned on a terminal end in the contact insertion direction and has a shape obtained by bending a flat plate a plurality of times. The main body part 17 has a cylindrical shape and is positioned between the front edge part 16 and the terminal end part 18 to couple the front edge part 16 and the terminal end part 18. The terminal end part 18 is formed by bending a flat metal plate having a strip shape into a cranky shape. Specifically, the terminal end part 18 includes an extending part 13 which extends in an opposite direction to the contact insertion direction, a bending part 12 which bends and extends from a terminal end of the extending part 13 in a direction orthogonal to the extending direction of the extending part 13 (the downward direction in FIG. 2B and FIG. 3), and a tail part 11 which bends and extends from a terminal end of the bending part 12 in the opposite direction to the contact insertion direction.

<Protruding Part 15>

As illustrated in FIG. 2B and FIG. 3, the main body part 17 is provided with a protruding part 15 which is formed to be protruded in the direction orthogonal to the contact insertion direction (the upward direction in FIG. 2B and FIG. 3). A cutout 15*a* is formed on a lateral surface (a cylindrical surface) of the main body part 17 on the periphery of the protruding part 15.

<Protrusion 14>

As illustrated in FIG. 2B and FIG. 3, three protrusions 14 are formed in total on an outer periphery (cylindrical surface) of the main body part 17 with 120 degrees of intervals thereamong, in the same plane which is orthogonal to the contact insertion direction. The number of protrusions 14 is not limited. For example, four or five protrusions 14 may be formed. The protrusion 14 is a part for adjusting concentricity of the connector as described later, so that it is suitable to form three or more protrusions.

<Overhanging Part 13*a*>

Overhanging parts 13*a* which are overhung in a spinous manner in a direction orthogonal to the contact insertion direction (the horizontal direction in FIG. 2B and FIG. 3) are formed on both sides of the extending part 13.

<Guide Groove 21>

Figure 2A:
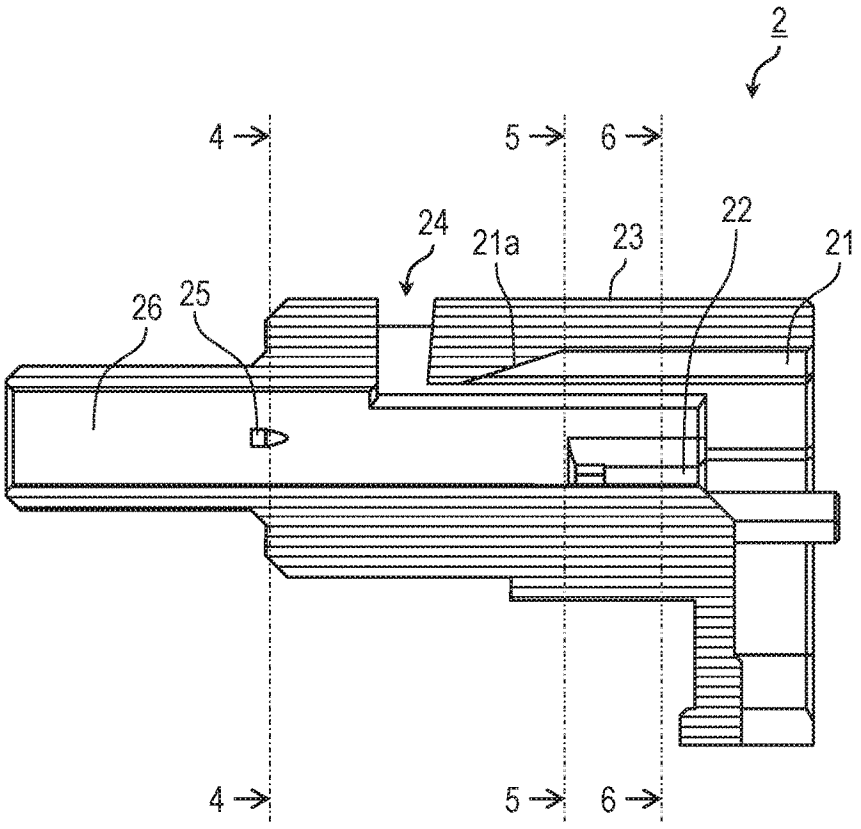
Figure 5:
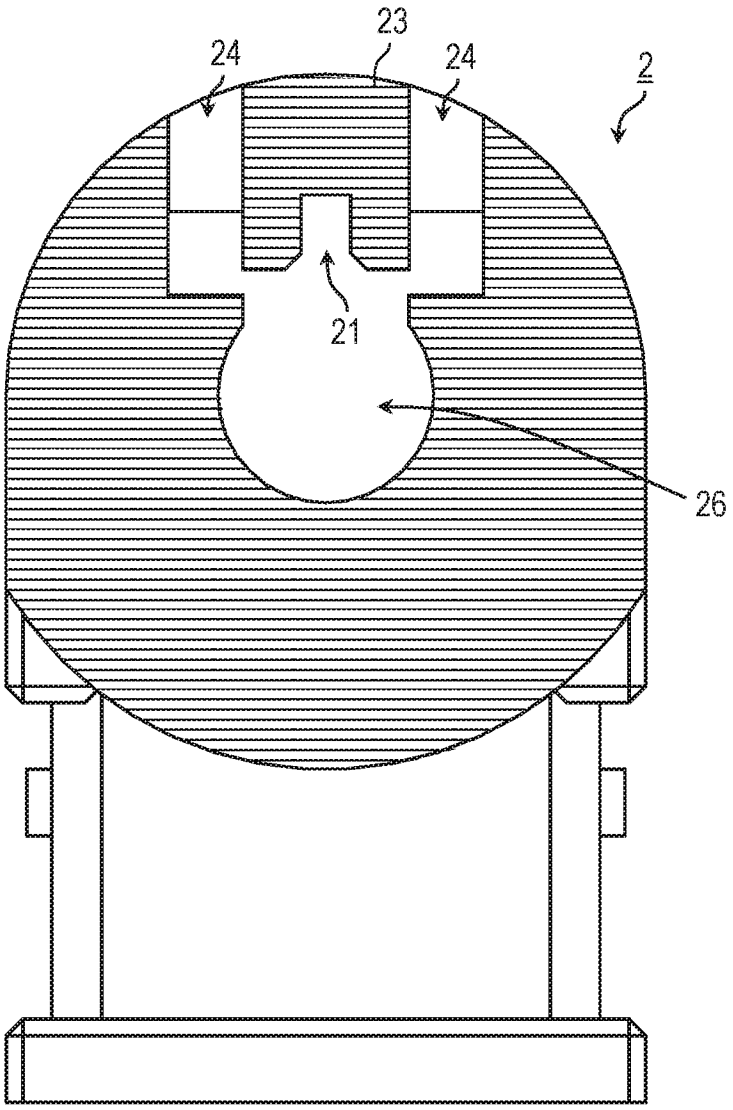
FIG. 5 is a sectional view on a 5-5 section of the body of the connector according to the first embodiment.

As illustrated in FIG. 2A and FIG. 5, the body 2 includes a guide groove 21, which is extended in the contact insertion direction and is fitted with the protruding part 15, on the inner surface thereof. The guide groove 21 is formed in a part of a cantilever spring 23 which is deformable in a protruding direction of the protruding part 15 (a direction from the inside to the outside of the body 2) and the opposite direction to the protruding direction (a sinking direction toward the contact 1).

<Inclination Part 21*a*>

The guide groove 21 includes an inclination part 21*a* which inclines so that the depth of the guide groove 21 decreases toward a front edge side in the contact insertion direction.

<Cantilever Spring 23 and Hole 24>

Figure 7:
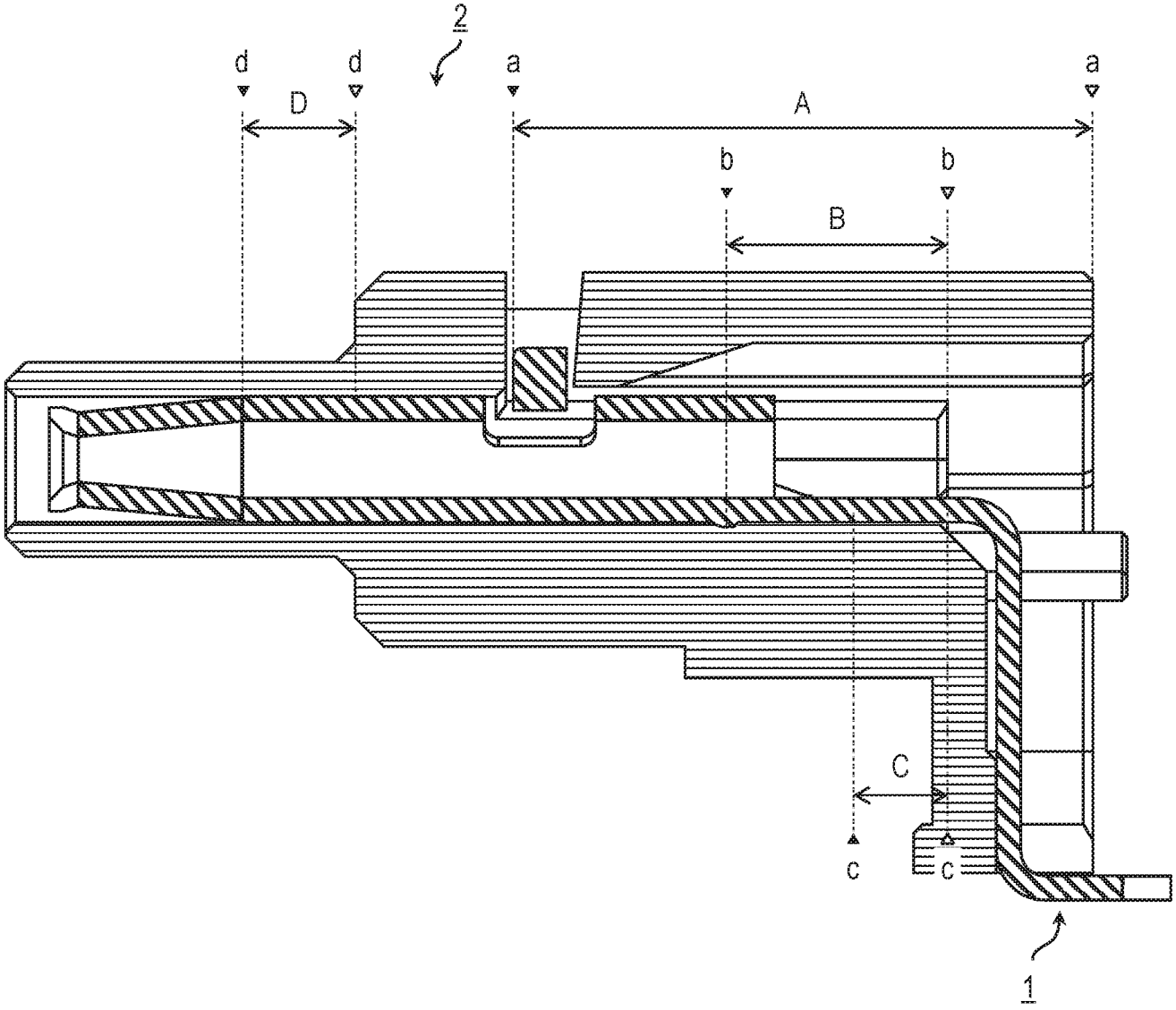
FIG. 7 is a sectional view on the 2-2 section of the body and the contact of the connector according to the first embodiment.

More specifically, a hole 24 surrounding the guide groove 21 in a U shape is formed on a lateral surface (cylindrical surface) around the guide groove 21. A rod-shaped part surrounded by the hole 24 obtained by hollowing the lateral surface (a part including the guide groove 21) is the cantilever spring 23 which is deformable in the above-described direction. A front edge side, in the contact insertion direction, of the hole 24 is adjacent to a front edge side, in the contact insertion direction, of the cantilever spring 23, and the hole 24 houses the protruding part 15 of the contact 1 at a terminal position as illustrated in FIG. 7.

<Fit Between Protruding Part 15 and Guide Groove 21>

The protruding part 15 of the contact 1 is inserted into the guide groove 21 while being fitted to the guide groove 21. In order not to affect control for concentricity, it is suitable to form the protruding part 15 in the height so that the protruding part 15 can be smoothly inserted through the guide groove 21. When the protruding part 15 passes the inclination part 21*a*, the protruding part 15 elastically deforms in a direction sinking into the main body part 17. At this time, the cantilever spring 23 elastically deforms in a protruding direction of the protruding part 15. The protruding part 15 fits into the hole 24 after passing the inclination part 21*a*, and a force pressing the protruding part 15 in the direction sinking into the main body part 17 is accordingly canceled, returning the protruding part 15 to an initial state. At this time, a force to raise the cantilever spring 23 toward the outside of the body 2 is canceled, returning the cantilever spring 23 to an initial state. Even if a force in a pulling out direction (the opposite direction to the contact insertion direction) is applied to the contact 1 in this state, the contact 1 cannot be pulled out because the front edge of the cantilever spring 23 is engaged with the protruding part 15. That is, the cantilever spring 23 functions as a retaining mechanism for the contact 1.

<Housing Part 26>

As illustrated in FIG. 2A and FIG. 5, the body 2 includes a housing part 26 that has a circular section and has an internal dimension for press-fitting the main body part 17 including the protrusions 14 thereto.

<Notch 22>

Figure 6:
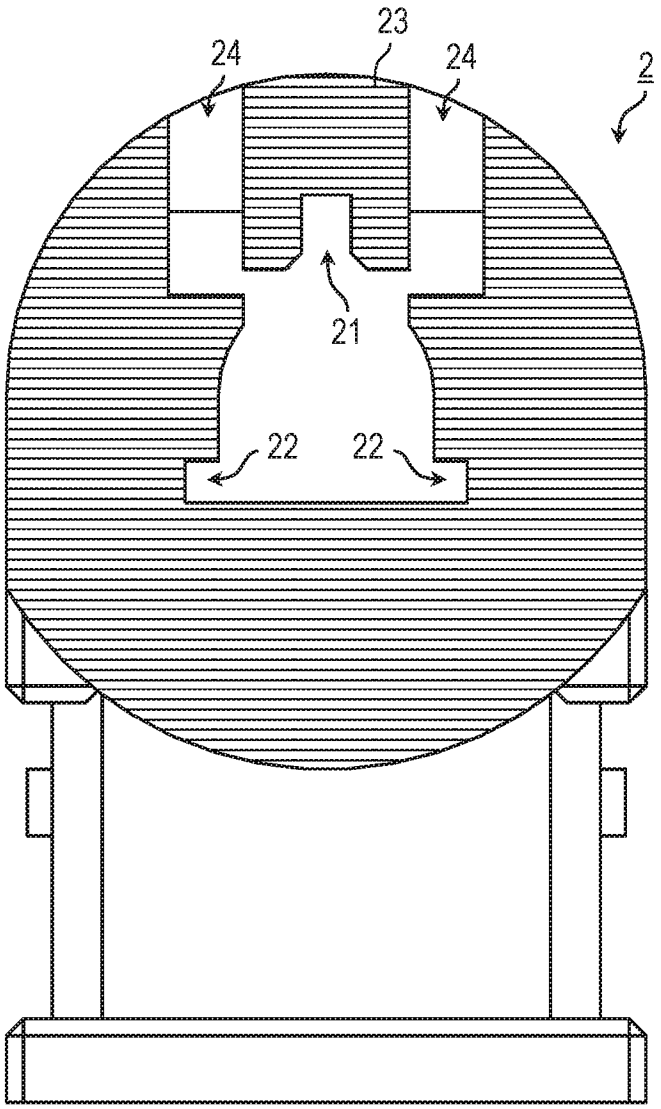
FIG. 6 is a sectional view on a 6-6 section of the body of the connector according to the first embodiment.

As illustrated in FIG. 2A and FIG. 6, the body 2 includes notches 22 having an internal dimension for press-fitting the extending part 13 including the overhanging parts 13*a* thereto. The notch 22 is also referred to as a press-fitting part 22.

<Projection 25>

Figure 4:
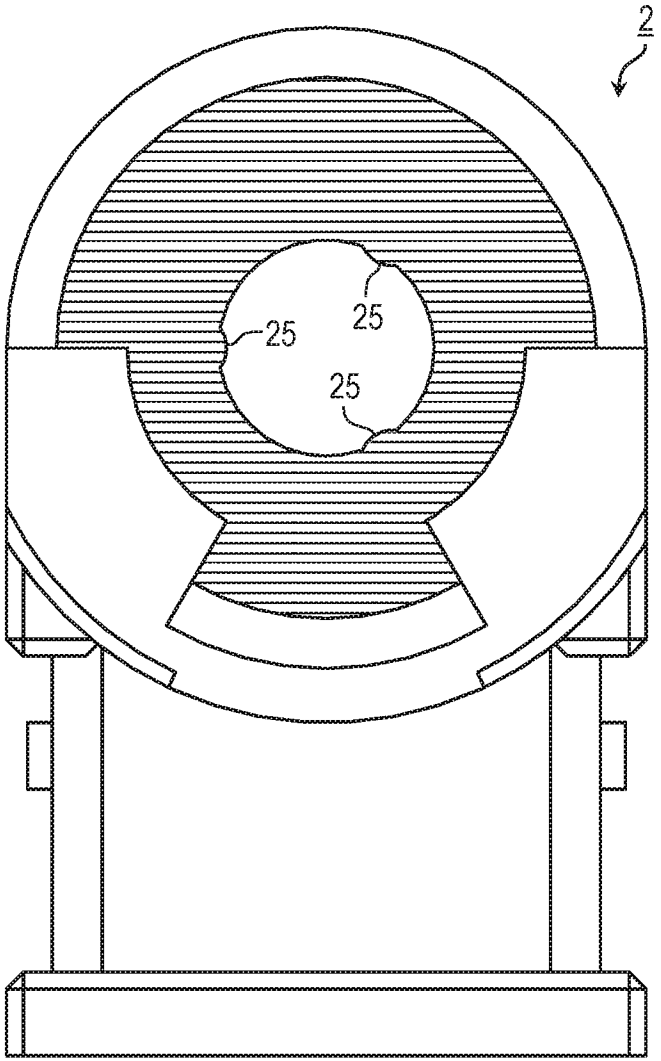
FIG. 4 is a sectional view on a 4-4 section of the body of the connector according to the first embodiment.

As illustrated in FIG. 2A and FIG. 4, projections 25 are formed on an inner periphery of the housing part 26 of the body 2. The projection 25 has a size for hindering insertion of the main body part 17 to the extent to allow press-fit of the main body part 17 without hindering insertion of the front edge part 16. Three projections 25 are formed in total with 120 degrees of intervals thereamong, in the same plane which is orthogonal to the contact insertion direction, as illustrated in FIG. 4. The number of projections 25 is not limited. For example, four or five projections 25 may be formed. The projection 25 is a part for adjusting concentricity of the connector as described later, so that it is suitable to form three or more projections.

<Insertion Distances A, B, C, and D>

An order for positioning in the contact 1 can be defined by defining a positional relation among the protruding part 15, the protrusions 14, the overhanging parts 13*a*, and the projections 25 that control positioning between the contact 1 and the body 2. Insertion distances A, B, C, and D of the above-described parts are described below. Terminal positions of respective parts of the contact 1 are marked with black triangle symbols as shown in FIG. 7. An insertion distance of the protruding part 15 from a position on which the protruding part 15 starts to fit in the guide groove 21 (a position marked with a white triangle symbol with a in FIG. 7) to a terminal position (a position marked with a black triangle symbol with a in FIG. 7) is denoted by A. An insertion distance of the protrusions 14 from a position on which press-fit of the protrusions 14 is started (a position marked with a white triangle symbol with b in FIG. 7) to a terminal position (a position marked with a black triangle symbol with b in FIG. 7) is denoted by B. An insertion distance of the overhanging parts 13*a* from a position on which press-fit of the overhanging parts 13*a* is started (a position marked with a white triangle symbol with c in FIG. 7) to a terminal position (a position marked with a black triangle symbol with c in FIG. 7) is denoted by C. An insertion distance of the main body part 17 from a position on which insertion of the main body part 17 starts to be hindered (a position marked with a white triangle symbol with d in FIG. 7) to a terminal position (a position marked with a black triangle symbol with d in FIG. 7) is denoted by D.

<Length Relation Among A, B, and C>

Regarding the length relation among A, B, and C, it is suitable to determine positions of respective parts so that the relation A>B>C is satisfied. A, B, C, and D described above denote insertion distances of respective parts to terminal positions (black triangles). The longer the insertion distance, the earlier timing at which corresponding parts start to fit to each other in assembly. When A>B>C is satisfied, A is the longest among the three lengths, meaning that the protruding part 15 and the guide groove 21 first fit with each other from the start of insertion of the contact 1. Further, B is the second longest and C is the shortest, meaning that press-fit of the protrusions 14 is started after the start of the fit between the protruding part 15 and the guide groove 21 and press-fit of the overhanging parts 13*a* is started after the start of the press-fit of the protrusions 14. Accordingly, the contact 1 can be positioned to the body 2 in the order that rotation about the insertion direction of the contact 1 is first controlled by the protruding part 15 and the guide groove 21, concentricity is then controlled by the press-fit of the protrusions 14 so that the center of the body 2 and the center of the contact 1 are accorded with each other, and the contact 1 is finally fixed (locked) to the body 2 by the press-fit of the overhanging parts 13*a*. Thus, a connector can be assembled in the order: control of a rotating direction→control of concentricity→fixation (lock), thereby being able to provide a connector that secures concentricity and exhibits high reliability.

<Length Relation Among A, D, and C>

Regarding the length relation among A, D, and C, it is suitable to determine positions of respective parts so that the relation A>D>C is satisfied. When A>D>C is satisfied, A is the longest among the three lengths, meaning that the protruding part 15 and the guide groove 21 first fit with each other from the start of insertion of the contact 1. Further, D is the second longest and C is the shortest, meaning that press-fit of the main body part 17 is started after the start of the fit between the protruding part 15 and the guide groove 21 and press-fit of the overhanging parts 13*a* is started after the start of the press-fit of the main body part 17. Accordingly, the contact 1 can be positioned to the body 2 in the order that rotation about the insertion direction of the contact 1 is first controlled by the protruding part 15 and the guide groove 21, concentricity is then controlled by the press-fit of the main body part 17 so that the center of the body 2 and the center of the contact 1 are accorded with each other, and the contact 1 is finally fixed (locked) to the body 2 by the press-fit of the overhanging parts 13*a*.

<Protrusion 14 and Projection 25, Length Relation Between B and D>

Both of the protrusion 14 and the projection 25 are parts for controlling concentricity. Concentricity between the body 2 and the contact 1 can be controlled at two positions on the front and the back in the connector insertion direction by providing both of the protrusions 14 and the projections and accordingly, distortion in an axis of the contact 1 to that of the body 2 can be accurately corrected. Roles of the protrusion 14 and the projection 25 are the same as each other, so that the length relation between the insertion distance B and the insertion distance D is not especially limited.

<Relation Among Guide Groove 21, Cantilever Spring 23, and Main Body Part 17>

It is suitable that the guide groove 21 and the cantilever spring 23 are configured not to be brought into contact with the main body part 17. Accordingly, the guide groove 21 and the cantilever spring 23 do not affect control for concentricity between the body 2 and the contact 1, and thus, concentricity of the connector can be controlled only by the protrusions 14 and the projections 25.

The foregoing description of the embodiment of the invention has been presented for the purpose of illustration and description. It is not intended to be exhaustive and to limit the invention to the precise form disclosed. Modifications or variations are possible in light of the above teaching. The embodiment was chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A connector comprising:

a body; and a contact that is inserted into the body, wherein the contact includes a protruding part that is protruded in a direction orthogonal to an insertion direction of the contact, a protrusion that is provided on an outer periphery of the contact, and an overhanging part that overhangs in the direction orthogonal to the insertion direction, the body includes, on an inner surface thereof, a guide groove that is fitted with the protruding part and is extended in the insertion direction, a housing part that has an internal dimension for press-fitting the contact, the contact including the protrusion, thereto, and a press-fitting part that has an internal dimension for press-fitting the contact, the contact including the overhanging part, thereto, and an insertion distance A of the protruding part from a position, on which the protruding part starts to fit in the guide groove, to a terminal position, an insertion distance B of the protrusion from a position, on which press-fit of the protrusion is started, to a terminal position, and an insertion distance C of the overhanging part from a position, on which press-fit of the overhanging part is started, to a terminal position satisfy a relation A>B>C.

2. The connector according to claim 1, wherein the contact includes a front edge part that is positioned on a front edge in the insertion direction and is formed to be tapered, a terminal end part that is positioned on a terminal end in the insertion direction and formed to be flat, and a main body part that is positioned between the front edge part and the terminal end part and couples the front edge part and the terminal end part, the protruding part and the protrusion are formed on the main body part, the overhanging part is formed on the terminal end part, the housing part has an internal dimension for press-fitting the main body part, the main body part including the protrusion, thereto, and the press-fitting part has an internal dimension for press-fitting the terminal end part, the terminal end part including the overhanging part, thereto.

3. The connector according to claim 2, wherein a projection is formed on an inner periphery of the housing part, the projection having a size for hindering insertion of the main body part to the extent to allow press-fit of the main body part without hindering insertion of the front edge part, and an insertion distance D of the main body part from a position, on which insertion of the main body part starts to be hindered, to a terminal position satisfies a relation A>D>C.

4. The connector according to claim 2, wherein regarding the protrusion, three pieces of protrusions are formed on an outer periphery of the main body part with 120 degrees of intervals thereamong.

5. The connector according to claim 3, wherein regarding the projection, three pieces of projections are formed on the inner periphery of the housing part with 120 degrees of intervals thereamong.

6. The connector according to claim 1, wherein the guide groove includes an inclination part that is formed on a part of a cantilever spring, the cantilever spring being deformable in a protruding direction of the protruding part and an opposite direction to the protruding direction, and inclines so that a depth of the guide groove decreases toward a front edge side in the insertion direction of the contact, and the body includes a hole that is adjacent to a front edge side, in the insertion direction, of the cantilever spring and houses the protruding part at a terminal position.

* * * * *